United States Patent [19]

Tullos et al.

[11] 4,313,318

[45] Feb. 2, 1982

[54] ADJUSTABLE KELLY BUSHING FOR DOWNHOLE DRILLING SYSTEM

[75] Inventors: Homan C. Tullos, Lafayette, La.; Dewey W. Woods, Livingston, Tex.

[73] Assignee: Tullos & Woods Tools, Inc., Lafayette, La.

[21] Appl. No.: 117,084

[22] Filed: Jan. 31, 1980

Related U.S. Application Data

[63] Continuation-in-part of Ser. No. 9,149, Feb. 5, 1979, Pat. No. 4,258,802.

[51] Int. Cl.[3] ..... E21B 17/00; E21B 3/04

[52] U.S. Cl. ..... 64/23.6; 175/104; 175/195

[58] Field of Search ..... 64/23, 23.5, 23.6, 23.7; 175/40, 45, 50, 103, 104, 106, 107, 195, 220, 173, 92

[56] References Cited

U.S. PATENT DOCUMENTS

| | | | |
|---|---|---|---|
| 763,253 | 6/1904 | Bunnell | 64/23.6 |
| 2,221,767 | 11/1940 | Hayward et al. | 175/40 X |
| 2,312,323 | 3/1943 | Derrick | 64/23.6 |
| 2,312,804 | 3/1943 | Derrick | 64/23.6 |
| 4,073,352 | 2/1978 | Underwood | 64/23.6 X |
| 4,258,802 | 3/1981 | Tullos et al. | 175/104 X |

*Primary Examiner*—Tony M. Argenbright

*Attorney, Agent, or Firm*—LeBlanc, Nolan, Shur & Nies

[57] ABSTRACT

A downhole drilling system utilizes a non-rotating kelly bushing for locking in the torque created in the drill string by the downhole drilling motor. The kelly bushing prevents rotational movement of the kelly secured to the drill string on which the downhole motor is attached. The kelly bushing includes a torque mechanism for enabling the kelly and the attached drill string to move in a forward direction into the hole being drilled while prohibiting any rotational movement. The torque mechanism includes a pair of rollers which are adapted to non-rotatably receive and vertically guide the kelly therebetween. The spacing between the rollers is adjustable to accommodate different sized kellys. A guide mechanism is provided in the kelly bushing for enabling an electrical wire to be attached to either the downhole motor or a sensing mechanism located in the area of the downhole motor for feeding back to the surface appropriate electrical signals indicative of certain drilling operations.

16 Claims, 14 Drawing Figures

FIG. 6
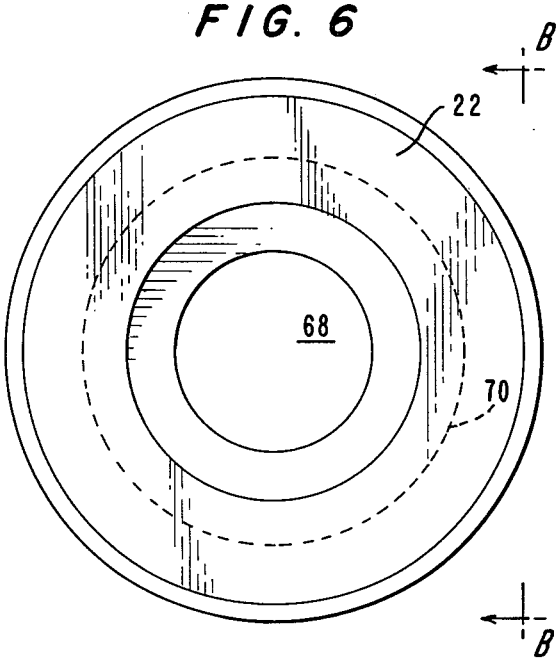
FIG. 7
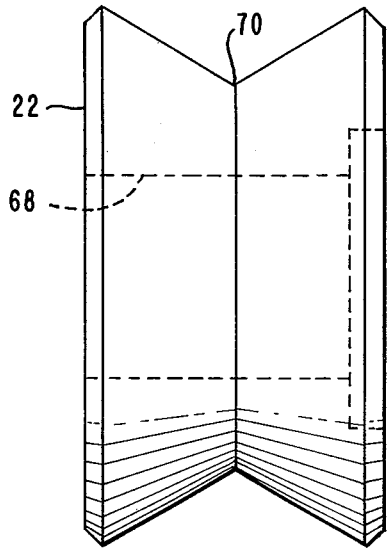
FIG. 8
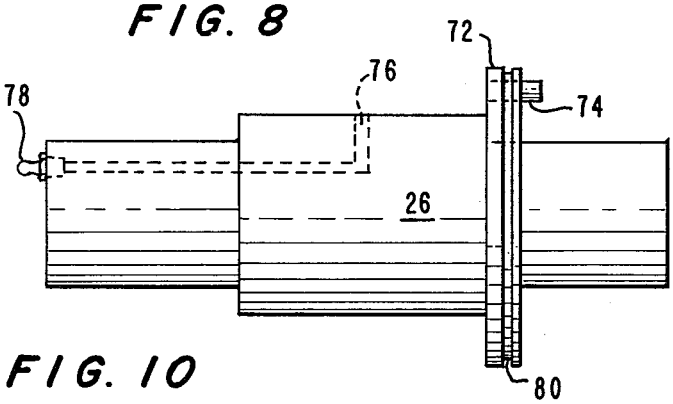
FIG. 9
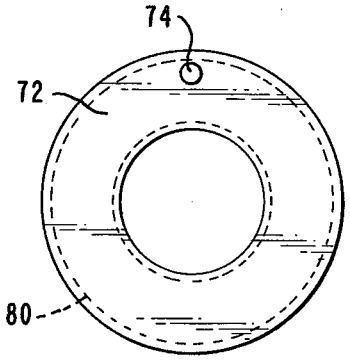
FIG. 10
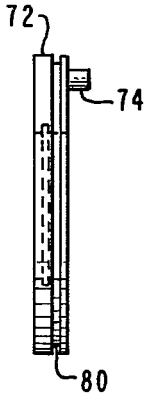
FIG. 11
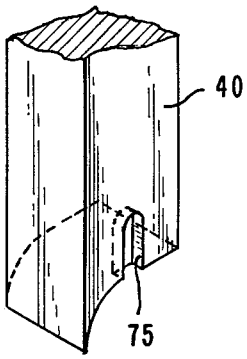
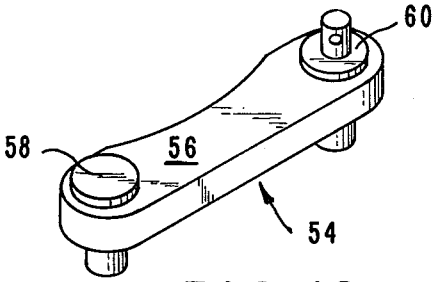
FIG. 12

ADJUSTABLE KELLY BUSHING FOR DOWNHOLE DRILLING SYSTEM

BACKGROUND OF THE INVENTION

This is a continuation-in-part of applicants' copending U.S. patent application Ser. No. 9,149, filed Feb. 5, 1979, now U.S. Pat. No. 4,258,802, and entitled "Downhole Drilling System", which is hereby incorporated by reference.

The present invention relates to downhole drilling systems and, more particularly, to an adjustable kelly bushing for use in a downhole drilling system.

In general, there are two approaches for carrying out the rotation of the drill during a drilling operation. Either the entire drill string on which the drilling bit is mounted can be rotated by a rotary mechanism from the surface, e.g., by a rotary table, or alternatively, the rotation of the drill bit can be carried out by a downhole motor. Typically, when rotating the pipe sections, a drilling fluid is pumped down through the drill pipe to help flush out the rock cuttings. The drilling fluid is then returned up the space between the drill string and the side of the hole being drilled. In general, the drilling fluid is a mud mixture which also serves to cool and lubricate the drill bit as the cuttings are removed. In order to enable the drill string with the attached bit to be rotated, mounted at the upper end of the drill string is a kelly. While the kelly engages the cylindrical drill pipe of the drill string, its external surface is non-cylindrical, typically hexagonal. The kelly then passes through an opening in the rotary table which has a corresponding shape as the external circumferential surface of the kelly. Thus, the rotary table engages the kelly and by spinning the table, the kelly and correspondingly the drill string and the drill bit are rotated. As the drill string advances forward in the earth, the drilling operation needs to be periodically stopped so as to add an additional pipe section. When employing a rotary table along with the hose assembly for supplying the drilling fluid, this procedure for adding an additional pipe section becomes a complex and a time consuming operation.

Under certain circumstances, it becomes desirable to utilize a downhole drilling motor in place of the rotary table. The deeper the hole, the further the drilling bit from the rotary table that supplies the power from the earth's surface. Thus, there is a great energy loss between the power source and the drilling bit. In such a situation, it is preferable to place the power source as close to the drilling bit as possible, thus, it becomes beneficial to employ a downhole motor. While the motor rotates the bit, a major factor in accomplishing the forward advance of the drilling bit is the weight applied by the drill string. Thus, the downhole drilling system must be capable of transmitting radial forces which are at an angle to the longitudinal axis of the drill string and longitudinal forces which are generally parallel to the longitudinal axis of the drill string. One exemplary embodiment of such a downhole drilling system is illustrated and described in U.S. Pat. No. 3,730,284 to Striegler. Other embodiments of downhole drilling systems employing various kelly bushings, are illustrated and described in U.S. Pat. Nos. 3,842,619 to Bychurch; 3,854,539 to Sweeney; and 3,913,352 to Oliver. Such downhole drilling systems can be either electrically or hydraulically driven.

During many points of the drilling operation, it is desirable to place some type of sensing equipment in the area of the downhole motor for feeding back to the surface various information concerning both the drilling operation and the characteristics of the hole being drilled. When employing such sensing equipment, an electric line from the surface must be connected to the sensing equipment. Prior to the present invention, when utilizing such sensing equipment, it has been necessary to employ a wireline circulating head along with the necessary hoses for supplying the drilling fluid instead of the conventional kelly type drilling system. With previously known arrangements for downhole drilling, there has not been any capability of feeding an electric line into the hole to the motor or sensing equipment while using the kelly. Thus, it has not been possible to fully exploit the advantages of a downhole drilling system in all situations because of such limitations. By requiring the use of the wireline circulating head and hoses for the drilling fluid whenever a sensing mechanism is to be employed, due to the extra time involved in adding additional pipe sections to the drill string, the complexity of the drilling operation and time involved is significantly increased.

It is also highly advantageous to provide a kelly bushing for use in a downhole drilling system which is readily adjustable to accommodate different sized kellys. Although adjustable kelly bushings have been previously proposed, the adjustable kelly bushings of the prior art have tended to be complicated in structure and expensive to manufacture. See, for example, U.S. Pat. No. 2,312,804 to Derrick and U.S. Pat. No. 4,095,656 to French which illustrate some types of adjustable kelly bushings previously proposed. Further, it is also known to provide for adjustment of a kelly bushing by employing a set of interchangeable rollers of different sizes which can be installed on the same housing. However, with such arrangements, it is necessary to completely dismantle the kelly bushing to change the rollers to accommodate different sized kellys. The required dismantling of the kelly bushings is time consuming and unnecessarily expensive. Moreover, the different sized replacement rollers are not always readily available at the drilling site. Another alternative is to provide separate kelly bushings for each different sized kelly to be used. However, this arrangement is even more expensive and commercially impractical.

SUMMARY OF THE INVENTION

An object of the present invention is to provide a downhole drilling system capable of being employed with an electrical measuring mechanism for measuring certain drilling operations and characteristics of the drilled hole during the drilling operation.

Another object of the present invention is to provide a kelly bushing capable of being used in a downhole drilling system so as to enable an electrical wire to be fed to a sensing mechanism located in the area of the downhole drilling motor.

It is also an object of the invention to provide a kelly bushing for use in a downhole drilling system which is conveniently adjustable to accommodate kellys of various sizes.

It is another object of the invention to provide an adjustable kelly bushing which eliminates the need for maintaining a large inventory of kelly bushings with different sized housings and rollers to accommodate kellys of various sizes.

A further object of the present invention is to provide a new and improved kelly bushing for enabling full exploitation of a downhole drilling system.

A still further object of the present invention is to provide a new and improved kelly bushing for improving the efficiency of a drilling operation in comparison to previously known systems as discussed above.

These objectives are accomplished by the employment of the downhole drilling system with the kelly bushing of the present invention. By employing the kelly bushing of the present invention, a downhole drilling system can be employed in place of the standard circulating head, or rotary table, and hose assembly for the drilling fluid that was mandatory in previously known systems when attempting to use electrical mechanisms within the hole being drilled. Exemplary of the electric systems that would be used in a drilling operation would be an electric eye compass for sensing the direction of forward movement of the drilling bit and other sensing equipment such as that made by Sperry Sun.

The directional downhole drilling system of the present invention includes a drill string formed by one or more drilling pipes, with additional pipes being added as the drilling bit advances into the earth, a downhole drilling motor and bit mounted on the end of the drill string in the hole, a kelly mounted on the other end of the drill string and a bushing for controlling the movement of the kelly. The kelly bushing enables the kelly to move in a forward direction into the hole while prohibiting rotational movement of the kelly thereby locking in the torque created within the drill string by the downhole motor. The kelly bushing includes a support mechanism, which allows such forward movement while prohibiting rotational movement, and a guide mechanism which enables an electrical wire to be fed into the hole to a sensing mechanism located within the hole without interfering with the passage of the kelly, which is mounted at the top of the drill string, through the support mechanism. Throughout the specification and claims herein, whenever reference is made to a drill string, that term is intended to refer to both one or more drilling pipes and the attached kelly that collectively form the drill string.

The support mechanism controls the movement of the kelly and hence the entire drill string includes a pair of V-shaped rollers for a hexagonal shaped kelly or flat rollers for a square shaped kelly. Each roller is rotatably mounted on a respective shaft which in turn is mounted in a corresponding pair of apertures provided in a set of support members. The kelly has a non-cylindrical circumferential shape, typically hexagonal, and passes between the two rollers such that it fits within the V-shaped grooves which prevent rotational movement of the kelly and hence the drill string. In the event that the kelly is square shaped, it passes between the two flat rollers in such a fashion that the square kelly fits within the flat rollers which bear on opposite sides of the kelly and prevent rotational movement of the kelly and hence of the entire drill string. The support mechanism, however, guides the kelly through the rotational movement of the rollers in a forward direction as the drill string advances into the hole being drilled.

The support mechanism also has a base member on which the support members are mounted and within that base member, there is an opening that constitutes the opening of the guide mechanism for enabling an electrical wire to be fed into the hole. That opening can be formed in the base either by a cut-out section over which a gate member is placed during operation of the drilling equipment or by a thin slot which is merely wide enough for the wire to pass through the slot. In either embodiment, the electrical wire can be fed through the base member to a position under the rollers thereby not interfering with the passage of the kelly through the support mechanism.

A preferred embodiment of the kelly bushing is designed to allow adjustment of the spacing between its rollers to accommodate different sized kellys. Preferably, the roller support mechanism comprises a plurality of upstanding support members located on the base member and provided with a set of spaced vertical slots for receiving a pair of shafts extending transversely between the support members on which the rollers are rotatably mounted. The kelly bushing includes insert means adapted to be received in each of the slots in the support members and provide a set of apertures wherein the shafts are contained. At least one pair of apertures corresponding to one of the shafts is shaped to permit the shaft to be adjusted to different horizontal positions therein to vary the spacing between the rollers to accommodate different sized kellys. Preferably, the apertures are elongated horizontally to permit adjustment of the shaft to its different horizontal positions. A plurality of screw members is threadably mounted in the support members and extend into the elongated apertures for engagement with the shaft to selectively position the shaft therein.

BRIEF DESCRIPTION OF THE DRAWINGS

FIG. 6 is a side elevational view of one of the rollers in the kelly bushing illustrated in FIG. 2.

FIG. 7 is a side elevational view of the roller shown in FIG. 6 taken along lines B—B.

FIG. 8 is a side elevational view of a shaft for supporting the roller illustrated in FIG. 6.

FIG. 9 is an elevational view of the face of the shaft plate of the roller shaft illustrated in FIG. 8.

FIG. 10 is a side elevational view of the shaft plate illustrated in FIG. 9.

FIG. 11 is a perspective view of a top portion of the bearing for securing the roller and roller shaft in place during operation.

FIG. 12 is a perspective view of a hinged gate as used in the kelly bushing illustrated in FIG. 4.

DESCRIPTION OF PREFERRED EMBODIMENTS

Figure 1:
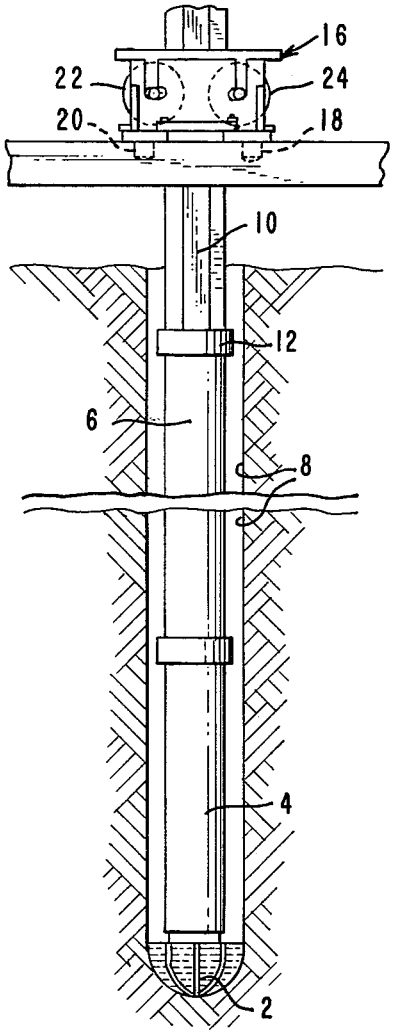
FIG. 1 is a perspective view of a downhole drilling system according to the present invention.

A directional drilling system according to the present invention is illustrated in FIG. 1. The drilling operation is carried out by a downhole motor and drill bit collectively labeled by the numeral 2, that is attached to the end of a drill string formed by a plurality of drill pipes, such as pipes 4 and 6, and kelly 10 that is attached to the upper portion of the drill pipes by a coupling 12. As illustrated, the drilling system serves to drill a hole 8. As the downhole motor and drilling bit 2 move in a forward direction so as to increase the depths of hole 8, additional drilling pipes are connected between the kelly and the uppermost drilling pipe thereby increasing the length of the drill string. Kelly 10 passes through an opening in rotary table 14 and through kelly bushing 16, which serves to control the movement of the kelly. The kelly bushing enables the kelly to move in a forward direction while prohibiting rotational movement of the kelly and hence locks in the torque created within the drill string by the rotation of downhole motor 2. Kelly bushing 16 is mounted on rotary table 14 by a plurality of mounting legs such as legs 18 and 20 which are secured within corresponding openings in the rotary table 14. Rotary table 14 is secured against rotation during normal operations.

Figure 2:
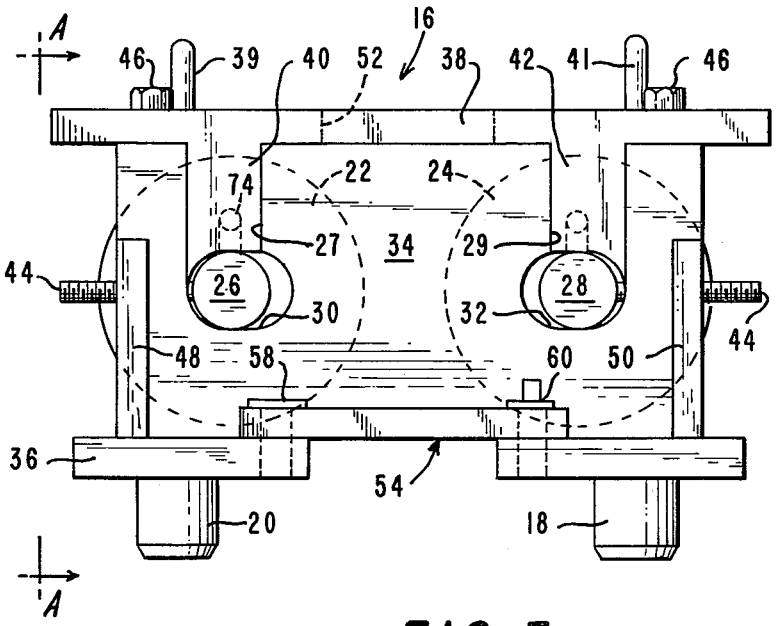
FIG. 2 is a front elevational view of a kelly bushing in accordance with the present invention.
Figure 3:
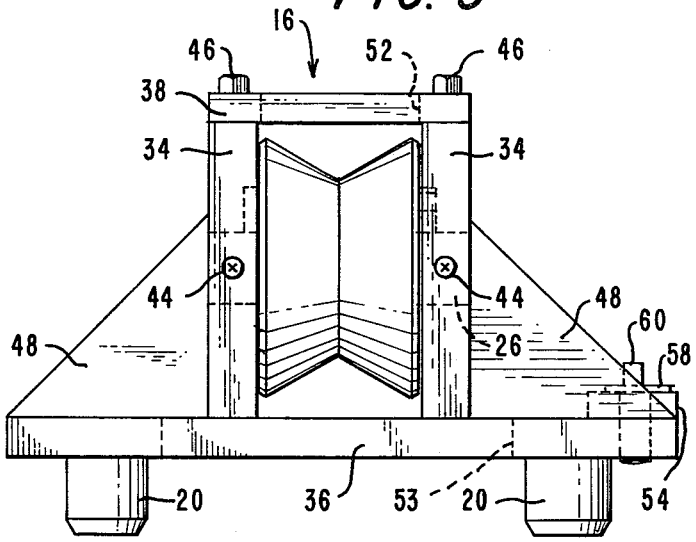
FIG. 3 is a side elevational view of the kelly bushing according to the present invention taken along lines A—A of FIG. 2.

As illustrated in FIG. 2, kelly bushing 16 includes a pair of rollers 22 and 24 which are mounted on a pair of rotatable shafts 26 and 28, respectively. These shafts are contained within apertures 30 and 32 which are located at the bottom of a set of vertical slots 27 and 29, respectively, formed at spaced locations in a pair of front and back plates 34. Front and back plates 34 are mounted in a spaced parallel configuration on a base member 36. A top plate or cover member 38 includes a set of depending legs 40 and 42 which are received in vertical slots 27 and 29, respectively, to close apertures 30 and 32 to contain the corresponding shafts 26 and 28 therein.

Preferably, one or both pairs of apertures 30 and 32 are elongated horizontally to permit adjustment of corresponding shafts 26 and 28 to different horizontal positions to adjust the spacing between rollers 22 and 24 to accommodate different sized kellys therebetween. For example, both vertical slots 27 and 29 may be formed $2\frac{7}{8}$ inches wide to receive shafts 22 and 24 of the same diameter. The lower ends of vertical slots 27 and 29 may be milled out by approximately $\frac{3}{4}$ inch in a direction toward the center of the kelly to horizontally elongate apertures 30 and 32. Since the length of elongated apertures 30 and 32 exceeds the diameters of shafts 22 and 24, the shafts are able to assume different horizontal positions within the apertures. Alternatively, vertical slots 27 and 29 and corresponding legs 40 and 42 can be enlarged in width to provide the elongated apertures which receive shafts 26 and 28.

A plurality of allen head screws 44 are threaded horizontally through the ends of support plates 34 and extend into apertures 30 and 32 for engagement with shafts 22 and 24. By turning screws 44, shafts 22 and 24 can be adjusted to different horizontal positions within elongated apertures 30 and 32 to vary the spacing between rollers 22 and 24 to accommodate different sized kellys.

All the elements of the kelly bushing are mounted on and secured to base plate 36. Rollers 22 and 24 are set in place by inserting shafts 26 and 28 in the lower portions of vertical slots 27 and 29 formed in front and back plates 34. Top plate 38 is placed over rollers 22 and 24 with its depending legs 40 and 42 inserted in slots 27 and 29 to contain shafts 26 and 28 within apertures 30 and 32 and to maintain the rollers in place within the kelly bushing. Top plate 38 is secured to front and back plates 34 by a set of bolts 46 which are threadably received in corresponding holes provided in the support plates. Once top plate 38 is locked into place, the entire kelly bushing can be lifted by handles 39 and 41 which are secured to the top plate.

Front and back plates 34 are provided with extra support against lateral movement by a plurality of triangular plates 48 and 50. The angular position of these triangular plates can be varied in order to vary the support against lateral movement. Once top plate 38 is securely fastened on front and back plates 34, a solid and firm support for rollers 22 and 24 for supporting and guiding the movement of the kelly is provided.

In using the kelly bushing 16 with the kelly, the kelly passes downward through an opening 52 (FIG. 4) in top plate 38. The kelly then passes between the two rollers 22 and 24 and out through an opening 53 in base plate 36.

Figure 4:
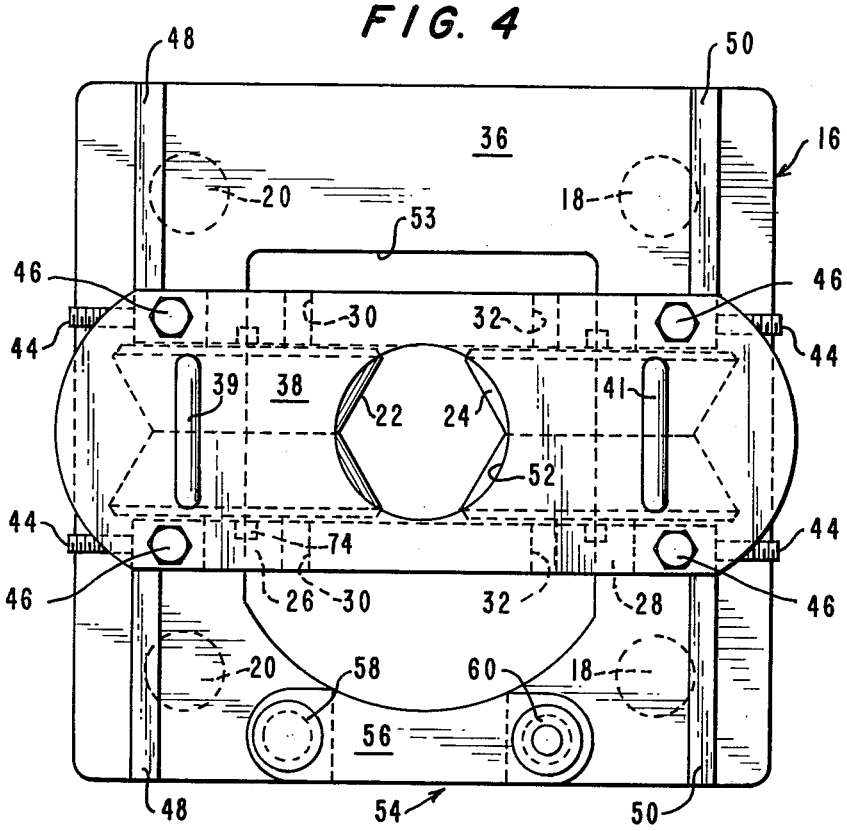
FIG. 4 is a top plan view of the kelly bushing illustrated in FIG. 2.

On one side of the kelly bushing, either front or rear, an opening or gap is provided in base member 36. The side opening is covered over by a gate mechanism 54, such as illustrated in FIG. 4. The gate mechanism includes a gate member 56 which is secured to base member 36 by hinge pin 58. The other end of the gate member is also attached to base member 36 but by a retaining pin 60 that can be removed whenever gate member 56 is to be opened. Whenever an electrical wire is to be inserted down into the hole, retaining pin 60 is removed, gate member 56 is opened thereby presenting the gap in base member 36 and the electrical wire is then fed through the gap in the base member to a position below the support rollers for the kelly and down into the hole. After the wire has been put into place, gate member 56 is closed and retaining pin 60 is reinserted to hold the wire within the kelly bushing during operation of the drilling system. A wireline side entry sub (not shown) is provided on the drill string which allows the electrical wire to pass downwardly therethrough to a sensing device (not shown) located above the downhole motor.

Figure 5:
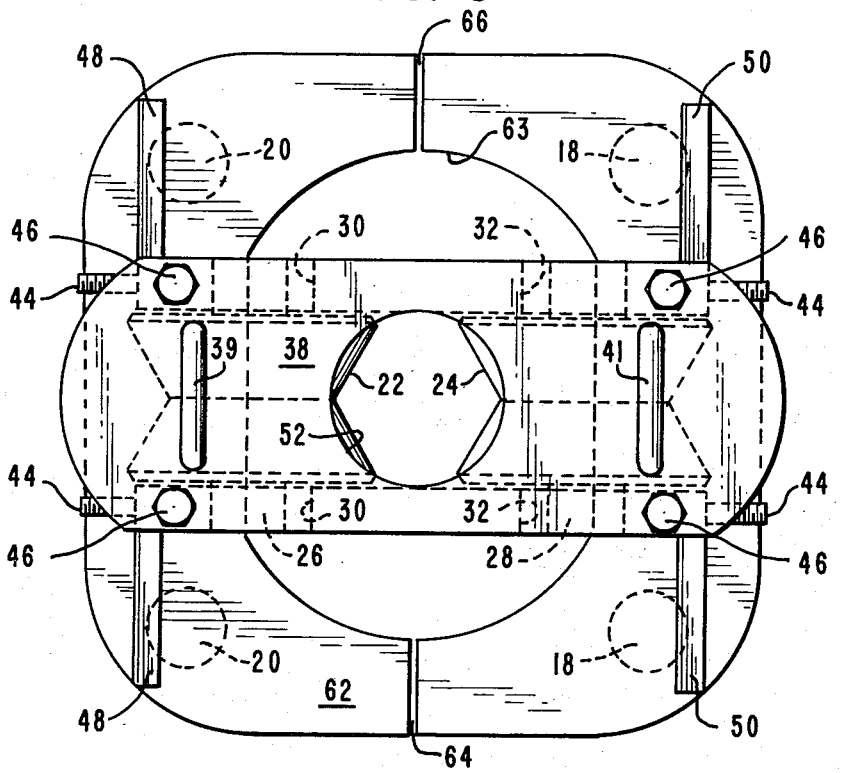
FIG. 5 is a top plan view of a modified embodiment of the kelly bushing according to the present invention.

In accordance with a modified embodiment of the present invention, in place of gate mechanism 54, a modified base member 62 having a central opening 63 and a plurality of slots formed therein can be used, such as shown in FIG. 5. Base member 62 is shown with two slots, 64 and 66, which extend radially outward on opposite sides of base member 62 and allow for passage of the electrical wire through either slot into opening 63 so that the wire can be fed to a position below the support rollers. If desired, each of the slots 64 and 66 may be covered by a pivotal latch (not shown) to selectively open and close the slot.

Each of the rollers for controlling the movement of the kelly, such as roller 22, has an opening 68 through its center such as shown in FIG. 6. Each of the rollers is approximately V-shaped such as shown by the V-shaped configuration 70 in FIG. 7. The V-shaped configuration allows the roller to firmly engage the kelly which has a non-cylindrical configuration typically a hexagonal configuration. Since the kelly fits within V-shaped grooves, the kelly and hence the entire drill string is locked against rotational movement. The kelly may be square in shape in which case each of the rollers is a cylinder instead of V-shaped. The cylindrically shaped configuration of the rollers allows the rollers to firmly engage the square shaped kelly by fitting firmly against opposite sides of the kelly. Since the kelly fits within the rollers bearing against it from opposite sides, the kelly and hence the entire drill string is locked against rotational movement.

The roller is mounted on an appropriate roller shaft such as shown in FIG. 8. Shaft 26 has a retaining plate 72 which secures the roller on the shaft and is locked against rotation movement by a pin 74 which is received in a recess 75 (FIG. 11) provided in leg 40 of top plate 38. A similar arrangement is provided on shaft 28 and leg 42. As shown in FIGS. 9 and 10, retaining plate 72 has a grease groove 80 which can be filled with an appropriate lubricant. A grease fitting 78 also is provided within shaft 26 which allows grease to be fed through an opening to a grease hole 76 for lubricating the roller itself. It should be kept in mind in this regard that the rollers are only being rotated due to the movement of the kelly and are not actually being driven. Hence, it is only necessary for the rollers to be able to freely rotate for enabling forward movement of the kelly and hence the drill string while preventing the rotational movement of the kelly and the drill string.

Figure 14:
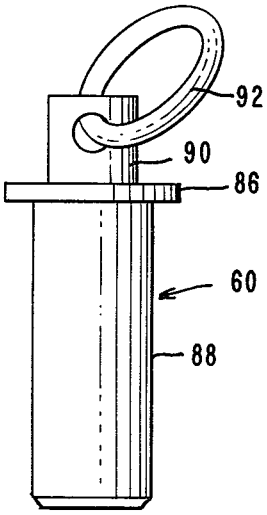
FIG. 14 is a side elevational view of a retaining pin used with the hinged gate illustrated in FIG. 12.
Figure 13:
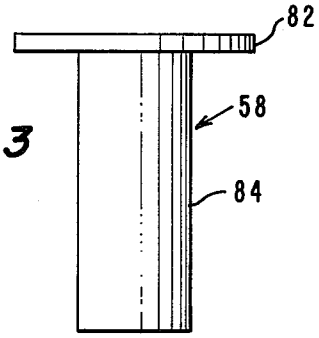
FIG. 13 is a side elevational view of the hinge pin used in the hinged gate illustrated in FIG. 12.

Additional illustrations of gate mechanism 54 and portions thereof are included in FIGS. 12, 13 and 14. As shown in FIG. 13, hinge pin 58 has a shaft portion 84 and top disc 82. Retaining pin 60 has a shaft portion 88, a top plate 86 and a top protuberance 90. Protuberance 90 has an opening therein through which a chain 92 passes. Chain 92 is used for enabling one to remove retaining pin 60 whenever the gate is to be opened.

The present invention may be embodied in other specific forms without departing from the spirit or essential characteristics thereof. The present embodiments are presented merely as illustrative and not restrictive, with the scope of the invention being indicated by the attached claims rather than the foregoing description. All changes which come within the meaning and range of equivalency of the claims are therefore intended to be embraced therein.

We claim:

1. An adjustable kelly bushing for use with a drill string provided with a kelly at its upper end, comprising:

a base;

support means provided on said base including a plurality of vertical slots formed therein and a pair of shafts mounted in said vertical slots;

a pair of rollers rotatably mounted on said shafts for receiving and guiding the kelly therebetween, said rollers being adapted to permit vertical movement of the kelly relative to said base but to preclude rotational movement of the kelly;

insert means adapted to be received in each of said slots and provide a set of apertures wherein said shafts are contained;

at least one pair of said apertures corresponding to one of said shafts being adapted to permit said shaft to assume different horizontal positions therein; and means for adjusting the position of said one shaft in its corresponding apertures to vary the spacing between said rollers to accommodate different sized kellys.

2. The adjustable kelly bushing of claim 1, wherein:

said one pair of apertures is elongated horizontally to permit adjustment of said one shaft to its different horizontal positions.

3. The adjustable kelly bushing of claim 2, wherein said adjusting means comprises:

a plurality of screw members threadably mounted in said support means and extending into said elongated apertures for engagement with the corresponding shaft to selectively position said shaft therein.

4. The adjustable kelly bushing of claim 1, which includes:

guide means provided on said base for receiving and guiding an electrical wire downwardly therethrough toward the lower end of the drill string.

5. An adjustable kelly bushing for use with a drill string provided with a downhole drilling motor at its lower end and a kelly at its upper end, comprising:

a base provided with an opening through which the kelly is vertically movable;

a pair of upstanding support members located on said base and spaced apart to allow the kelly to move vertically therebetween through said opening, each support member including a pair of vertical slots formed at spaced locations therein;

a pair of spaced, parallel shafts extending transversely between said support members and mounted in said vertical slots;

a pair of rollers mounted on said shafts for receiving and guiding the kelly therebetween, said rollers being adapted to permit vertical movement of the kelly relative to said base but to preclude rotational movement of the kelly;

a cover member including a plurality of depending legs each adapted to be received within one of said vertical slots of said support members and provide a set of apertures wherein said shafts are contained, said cover member including an opening through which the kelly is vertically movable;

at least one aperture in each support member being elongated horizontally to permit one of said shafts to assume different horizontal positions therein; and means for adjusting the position of said one shaft in said elongated openings to vary the spacing between said rollers to accommodate different sized kellys.

6. The kelly bushing of claim 5, which includes:

guide means provided on said base for receiving and guiding an electrical wire through said opening in said base for connection to said downhole drilling motor.

7. The adjustable kelly bushing of claim 5, wherein:

each of said horizontally elongated apertures is greater in length than the diameter of the corresponding shaft to permit said shaft to be adjusted to different horizontal positions.

8. The adjustable kelly bushing of claim 7, wherein said adjusting means comprises:

a plurality of screw members threadably mounted in said support members and extending into said horizontally elongated apertures for engagement with the corresponding shaft to selectively position said shaft therein.

9. An adjustable kelly bushing for use with a drill string provided with a downhole drilling motor at its lower end and a kelly at its upper end, comprising:

a frame member;

a pair of rollers rotatably mounted on said frame member for receiving and guiding the kelly therebetween, said rollers being adapted to permit axial movement of the kelly relative to said frame member but to preclude rotational movement of the kelly, at least one of said rollers being laterally adjustable in position on said frame member;

means mounted on said frame member for selectively adjusting the spacing between said rollers to accommodate different sized kellys; and guide means provided on said frame member for receiving and guiding an electrical wire downwardly therethrough toward the lower end of the drill string.

10. The adjustable kelly bushing of claim 9, wherein said frame member comprises:

a base provided with an opening through which the kelly is vertically movable; and roller support means provided on said base and adapted to rotatably support said rollers to allow the kelly to move vertically therebetween through said opening in said base.

11. The adjustable kelly bushing of claim 10, wherein said guide means comprises:

a slot formed in said base in communication with said opening to permit the electrical wire to be fed therethrough underneath said rollers to the lower end of the drill string.

12. The adjustable kelly bushing of claim 11, wherein said guide means includes:

a hinged gate member mounted adjacent to said slot and pivotal between open and closed positions to selectively permit the wire to be moved through said slot in said base.

13. The adjustable kelly bushing of claim 10, wherein said roller support means comprises:

a pair of spaced, parallel support plates extending upwardly from said base, each support plate including a pair of vertical slots formed at spaced locations therein; and a pair of spaced, parallel shafts extending transversely between said support plates and received in said vertical slots on which said rollers are rotatably mounted.

14. The adjustable kelly bushing of claim 13, wherein said frame member includes:

a cover member having a plurality of depending legs, each adapted to be received within one of said vertical slots of said support plates to define a set of apertures wherein said shafts are contained, said cover member including an opening through which the kelly is vertically movable.

15. The adjustable kelly bushing of claim 14, wherein:

at least one aperture in each support plate is elongated horizontally to permit one of said shafts to assume different horizontal positions therein.

16. The adjustable kelly bushing of claim 15, wherein said adjusting means comprises:

a plurality of screw members threadably mounted in said support plates and extending into said elongated apertures for engagement with the corresponding shaft to selectively position said shaft therein.

* * * * *